US005564858A

United States Patent [19]

Bravo

[11] Patent Number: 5,564,858

[45] Date of Patent: Oct. 15, 1996

[54] PROTECTIVE COLLAR FOR FILL PIPE ADAPTOR

[76] Inventor: Sergio M. Bravo, 2872 Tigertail Dr., Los Alamitos, Calif. 90720

[21] Appl. No.: 293,652

[22] Filed: Aug. 22, 1994

[51] Int. Cl.[6] ..... B65B 3/06

[52] U.S. Cl. ..... 405/52; 137/312; 141/86

[58] Field of Search ..... 405/52, 128; 137/312, 137/313, 363; 141/86

[56] References Cited

U.S. PATENT DOCUMENTS

| | | | |
|---|---|---|---|
| 4,278,115 | 7/1981 | Briles et al. | 141/86 |
| 4,659,251 | 4/1987 | Petter et al. | 137/312 X |
| 4,762,440 | 8/1988 | Argandona | 405/52 |
| 4,763,806 | 8/1988 | Podgers et al. | 141/86 X |
| 4,793,387 | 12/1988 | LeBlanc et al. | 137/312 X |
| 4,807,675 | 2/1989 | Sharp | 141/86 |
| 4,960,346 | 10/1990 | Tamayo | 405/52 |
| 5,100,024 | 3/1992 | Bravo | 137/312 X |
| 5,167,470 | 12/1992 | Bertolozzi et al. | 137/312 X |
| 5,341,857 | 8/1994 | Bravo | 137/312 X |

*Primary Examiner*—Frank S. Tsay
*Attorney, Agent, or Firm*—Christie, Parker & Hale, LLP

[57] ABSTRACT

A protective collar for a nozzle adaptor and fill pipe assembly includes a collar body with upper throughholes and lower throughholes. The upper throughholes have bolts or set screws passing therethrough for contacting the nozzle adaptor, and the lower throughholes have threaded rods passing therethrough for contacting the standpipe. Bracing assemblies are telescopically mounted on the threaded rods. The bracing assemblies are T-shaped and include friction pads for contacting inner walls of a spill bucket in which the fill pipe is located and are connected to the protective collar by a tubular stem fitted over the threaded rods. There is a nut for telescoping the T-shaped bracing member outwardly against the walls to engage the walls and prevent rotation of the nozzle adaptor. In another embodiment, the nozzle adaptor and collar are unitarily formed.

9 Claims, 5 Drawing Sheets

TANKER 2
4
6
22
14
20
30
32
38
32
54
52
40
44
46
48
50
48
34
34
44
16
18
STORAGE TANK

Fig. 7
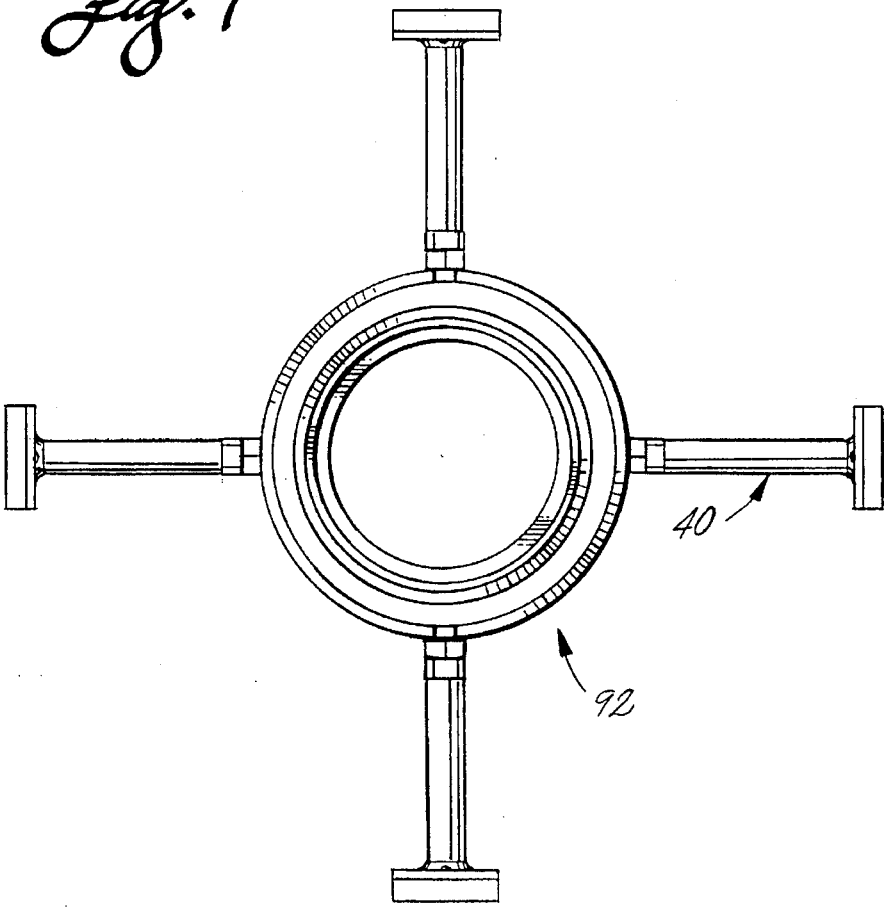
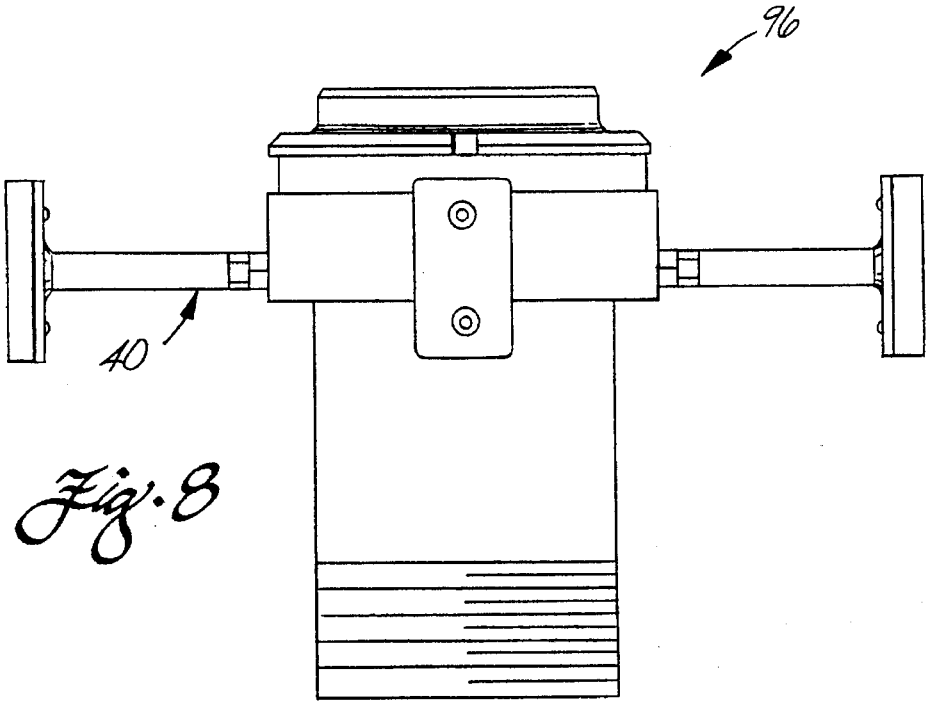
Fig. 8

PROTECTIVE COLLAR FOR FILL PIPE ADAPTOR

FIELD OF THE INVENTION

The present invention relates to a protective collar for a gasoline fill pipe adaptor, and more particularly to a collar for preventing loosening of the fill pipe adaptor during filing of an underground gasoline tank with gasoline.

BACKGROUND OF THE INVENTION

In a gasoline station, there is an underground gasoline storage tank for supplying gasoline dispensers ("pumps"). The storage tank is periodically refilled from a gasoline tanker. This refilling process is accomplished by means of a hose connected to the tanker at one end and having a nozzle inserted into a nozzle adaptor at the top of a fill pipe or riser leading to the underground storage tank. Typical adaptors, as made by Emco Wheaton and other companies, are threaded to the top of the fill pipe.

Periodically, these adaptors are found to be lose, e.g., by an environmental official or inspector who can fine the station owner for this hazardous condition. It has been discovered that this loosening of the adaptor sometimes occurs as a result of the refilling process. That is, when the tanker finishes pumping gasoline into the fill pipe, there is still a substantial amount of gasoline in the hose connected to the tanker. The operator typically picks up the hose at the tanker, holds the hose up, and walks towards the fill pipe causing the excess gasoline in the hose to flow into the fill pipe, This works well to avoid spilling or wasting gasoline, but the hose acts as a lever and often rotates and/or loosens the threaded adaptor.

What is needed is a way of preventing loosening of the adaptor to avoid such a hazardous condition and the costs of spilled gasoline creating a fire hazard and causing contamination.

SUMMARY OF THE INVENTION

In accordance with the invention, a protective collar which overlaps part of the fill pipe and part of the adaptor is provided. The collar has a plurality of threaded rods which contact the fill pipe, and set screws for tightening against the adaptor to prevent rotation of the adaptor.

In one embodiment, the collar is provided with a bracing mechanism to brace the collar against the interior of the spill bucket in which the fill pipe is provided to prevent transference of the torque from the hose to the bottom of the fill pipe where it connects to the underground storage tank or piping leading to the tank. The bracing mechanism includes a T-shaped element with a hollow stem that fits over a threaded rod. The rod has an inner nut fixed to it, which nut may be used to tighten the rod until it meets the fill pipe. The rod also has an outer nut threaded to it, which outer nut may be used to move the T-shaped element out against walls of the spill bucket. Inward movement of the outer nut allows the collar to fit into the spill bucket in which the standpipe is located and outward movement creates a pressure or friction fit between the T-shaped bracing elements and the walls, thereby bracing the fill pipe against the transference of the lever action from the hose through the adaptor and collar to the fill pipe, as well as preventing rotation of the adaptor.

BRIEF DESCRIPTION OF THE DRAWINGS

The preferred embodiment of the invention will become more evident upon reading the detailed description below, in conjunction with the drawings, in which:

FIG. 7 is a top view of the assembly of FIG. 6; and

FIG. 8 is a side view of a one-piece collar and adaptor assembly in accordance with a fourth embodiment of the invention.

DETAILED DESCRIPTION

Figure 1:
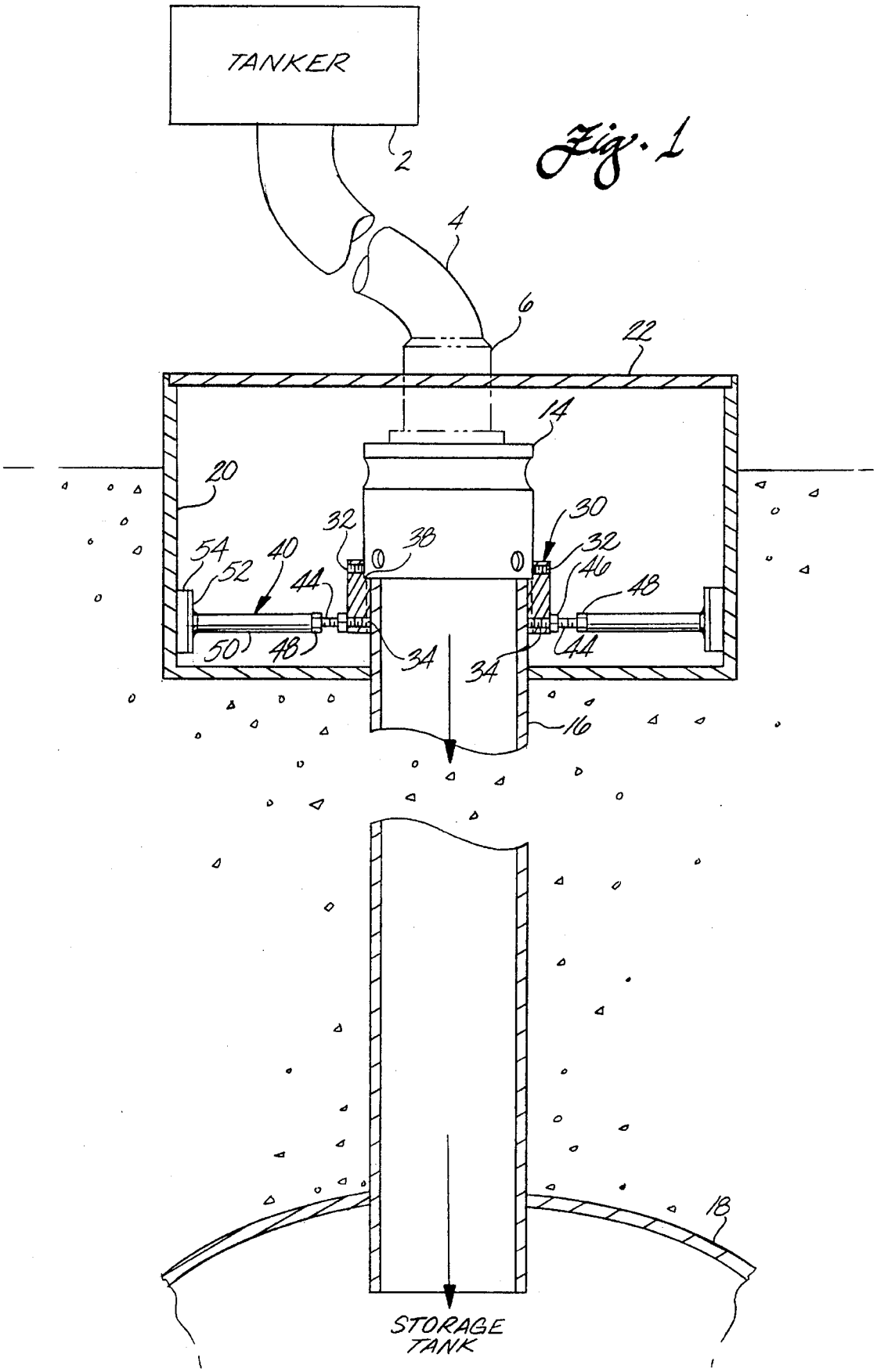
FIG. 1 is a partial sectional view of a protective collar, according to a first embodiment of the invention, in place on a fill pipe and adaptor for access to an underground gasoline storage tank.

FIG. 1 shows a service station where a tanker 2 having a flexible hose 4 with a nozzle 6 is filling an underground storage tank 18. The nozzle is inserted into a nozzle adaptor 14 threaded to the top of a fill pipe 16 or riser which is, in turn, connected to the storage tank 18. The nozzle adaptor 14 is located within a manhole 20 or spill bucket having a cover 22. In order to prevent the adaptor 14 from becoming loose on the fill pipe 16, a protective collar 30 in accordance with the invention is provided. Collar 30 has upper threaded holes 32 for upper set screws or bolts and lower threaded holes 34 formed in a collar body 36. The upper portion of the collar body has an indentation 38 for receiving the bottom of the adaptor. In a typical adaptor made, for example, by Emco Wheaton, the bottom of the adaptor has an octagonal shape and so the indentation 38 would have a matching octagonal shape. In practice, the collar is placed over the fill pipe before the adaptor is connected to the fill pipe, and lower bolts (shown and described later), preferably four in number at 90°, are tightened softly against the fill pipe just below its threads to hold the collar in place. Then, the adaptor is threaded onto the top of the fill pipe, and the upper set screws or bolts 60 (FIG. 3), also preferably four in number at 90°, are then tightened against the adaptor sufficiently to prevent relative rotation. This assembly thus provides a positive force against loosening of the adaptor.

Figure 2:
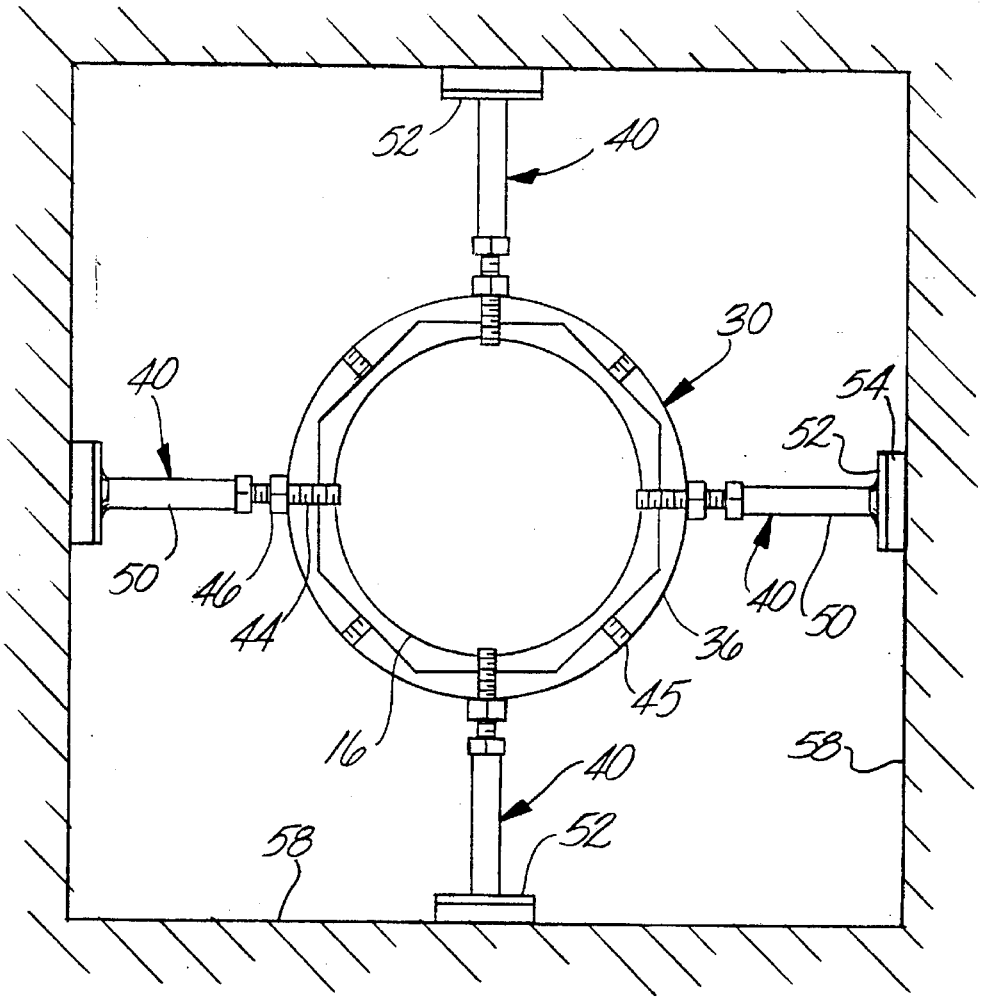
FIG. 2 is a top sectional view of the embodiment of FIG. 1 showing bracing for the collar in accordance with the first embodiment of the invention.
Figure 3:
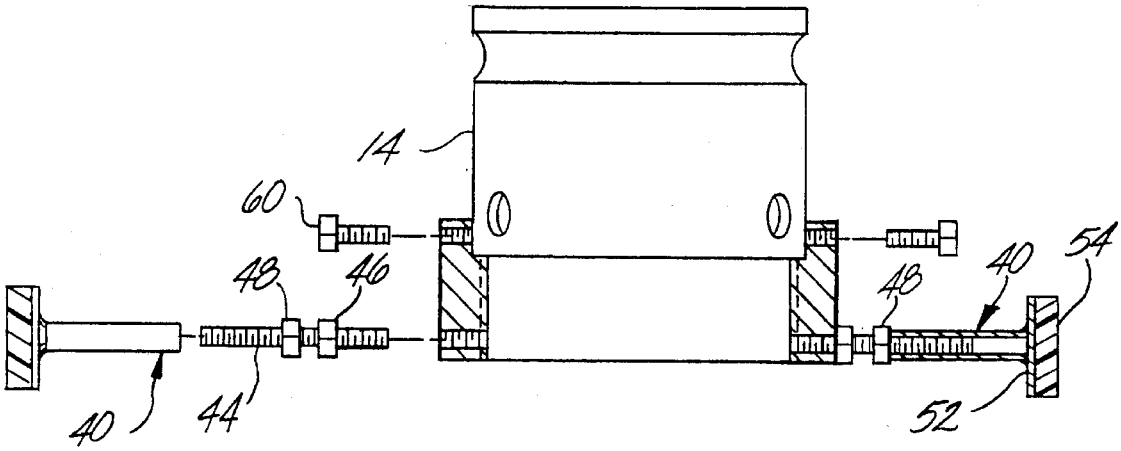
FIG. 3 is a vertical sectional and partial exploded view of the collar and bracing.

FIGS. 2 and 3 show the collar 30 on the fill pipe and adaptor. The collar has bracing assemblies 40. In particular, each bracing assembly has a means, such as a threaded rod 44, a fixed nut 46 for tightening rod 44, preferably softly but directly against fill pipe 16, and a movable nut 48, for telescopically mounting the assembly. The bracing assembly further includes a T-member 50 having a tubular stem for fitting over the threaded rod 44. The cross member 52 of the T-member is formed, preferably integrally or unitarily with the tube portion of the T-member and in a substantially planar shape. A friction pad 54 is then fitted to the cross member 52 and affixed thereto by screws or other appropriate means. The friction pad 54 then is pressed against the sidewalls 20 of the spill bucket by threading the movable nut 48 outward along rod 44 sufficiently to brace the fill pipe against lever action from the hose being transferred to the base of the fill pipe and to frictionally engage the walls of the spill bucket to prevent rotation of the adaptor.

Figure 4:
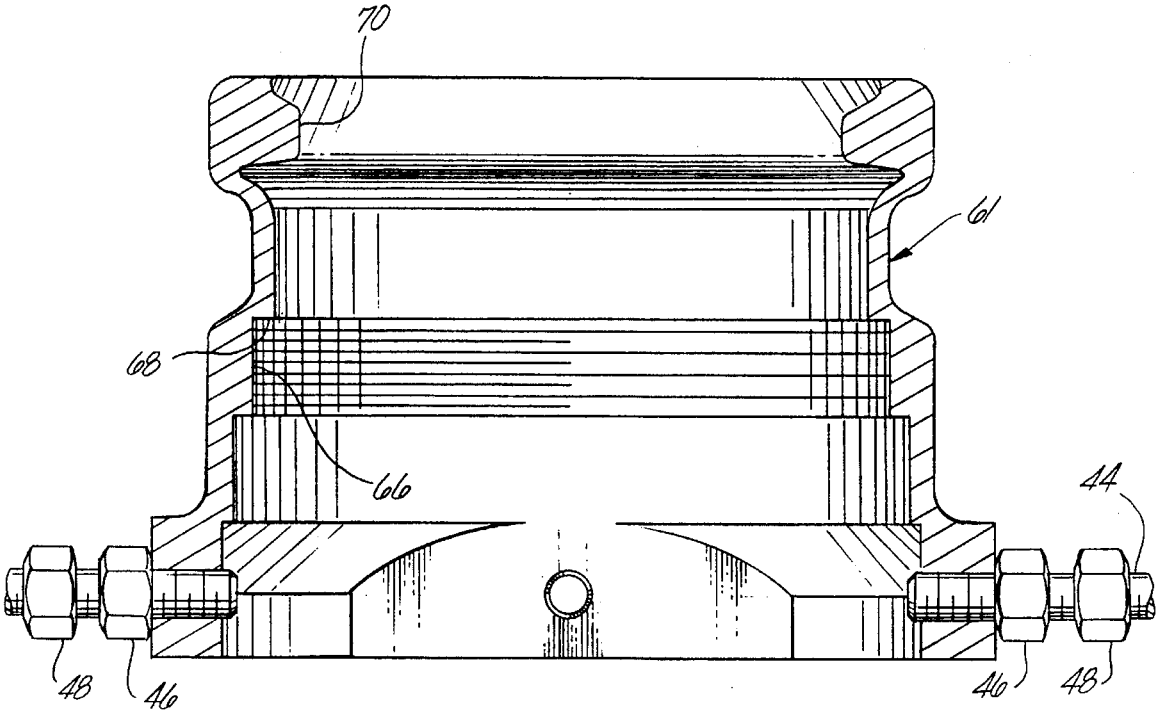
FIG. 4 is a vertical sectional view of a one-piece adaptor and collar in accordance with a second embodiment of the invention.

FIG. 4 shows a sectional view of an adaptor 61 similar to that of FIGS. 1–3, but the collar is formed unitarily or integrally with the adaptor. With this structure, the upper set screws or bolts are eliminated. Moreover, the combined adaptor and protective collar has internal threads 66 and a ridge 68 for threading to and sitting on top of the fill pipe. Indentations or knobs 70 are provided at the top of the combined structure to enable use of a spanner wrench, or the like, to tighten the structure onto the fill pipe or loosen it.

If such a collar is used without a bracing assembly, lever action of the hose on the adaptor, collar, and fill pipe can loosen or break the fill pipe at its base.

Figure 5:
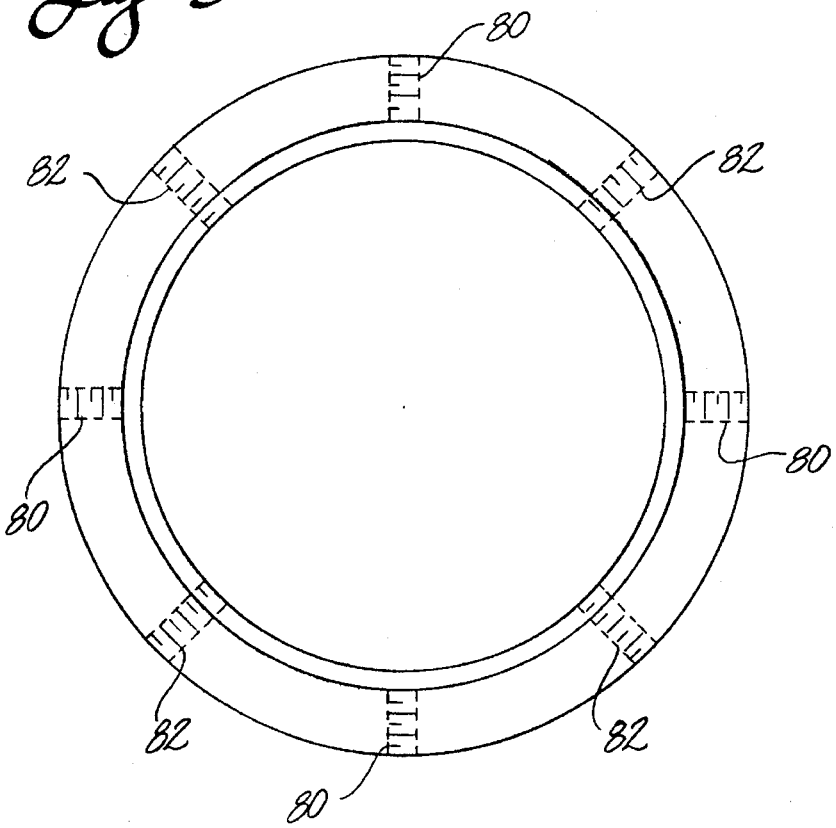
FIG. 5 is a top view of a collar in accordance with a third embodiment of the invention.
Figure 6:
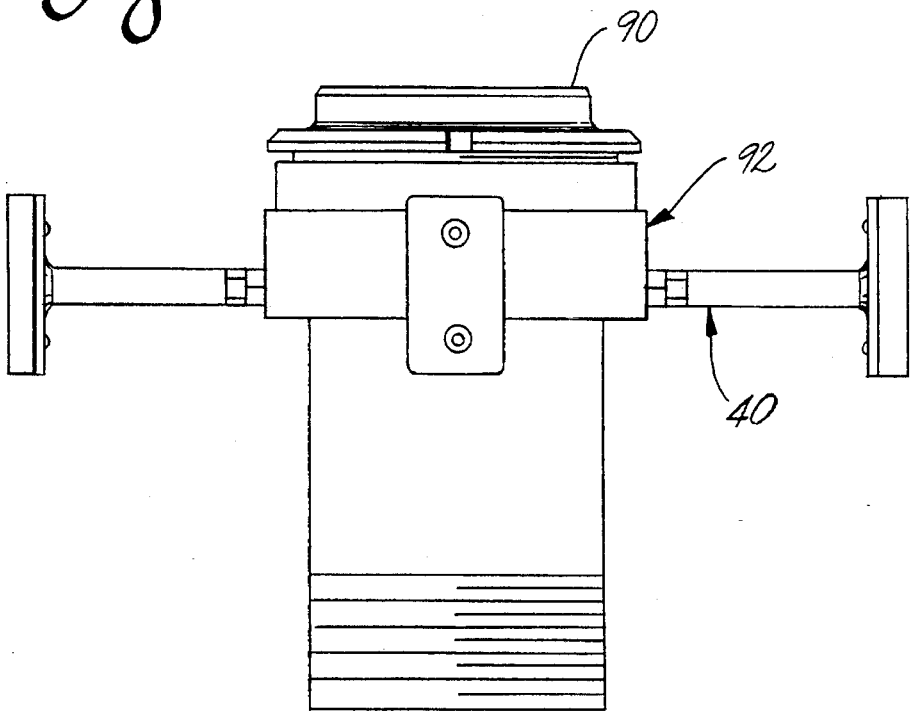
FIG. 6 is a side view of a collar, adaptor and fill pipe assembly in accordance with the third embodiment of the invention.

In FIGS. 5–7, another version of the invention is shown in which a protective collar 92, similar to the collar of FIGS. 1–3, is used. This collar, however, instead of having an octagonal internal shape at the upper throughholes, has a round shape for supporting a side seal nozzle adaptor. The upper and lower screw holes 80, 82 function in the same way as the screw holes of the collar of FIGS. 1–3. The bolts are not shown in FIG. 5 for the sake of simplicity.

In FIGS. 6 and 7, a side seal nozzle adaptor 90 is shown with the protective collar 92 and the same bracing structure 40 as in FIGS. 2 and 3.

In the embodiment of FIG. 8, a protective collar similar to that of FIGS. 5–7 is integrally or unitarily formed with a nozzle adaptor to form a combined structure 96, similar to the way FIG. 4 shows an integral or unitary structure for the nozzle adaptor and collar of FIGS. 2 and 3.

The invention may be used with any fill or vapor adaptor. Preferably, the collar is aluminum, and where the collar and adaptor assembly are formed together, they are made of aluminum or brass. The T-shaped sliding members are formed of stainless steel. The padding on the T-shaped members is preferably a rubber which would have good resistance to gasoline. Of course, other suitable materials may be used.

The invention has been shown with four upper screw holes and four lower screw holes or four bracing assemblies, however, these numbers can vary as desired or needed. For example, in a round spill bucket, three bracing assemblies placed at 120° would be quite suitable.

The collars in the side seal assemblies have U-shaped cutouts to provide room for a clamping nozzle from a typical hose.

The one-piece structure is particularly useful for top seal adaptors because such adaptors have certain structure including a nut which is difficult for a collar to fit over without a special design.

The embodiments of the invention described herein are merely exemplary and numerous versions will be evident to those of ordinary skill of the art. Accordingly, the scope of the invention is to be determined by the appended claims as interrupted in law and equity, and not limited to the disclosed embodiments.

What is claimed is:

1. A protective collar for a nozzle adaptor threaded onto a fill pipe having an axis, comprising:

(a) a collar body of annular shape and having upper threaded holes;

(b) means threaded through the upper holes for clamping against the nozzle adaptor; and (c) a bracing assembly mounted to the collar for bracing against and engaging walls of a spill bucket in which the fill pipe is located, whereby rotation of the nozzle adaptor with respect to the axis of the fill pipe is positively prevented due to the bracing of the nozzle adaptor against the walls.

2. The collar of claim 1 wherein each bracing assembly comprises a T-Shaped member having a tubular stem and a cross member having one side attached to the tubular stem and another side, opposite the one side, having a friction pad attached thereto.

3. The collar of claim 2 further comprising means for telescopically mounting each bracing assembly to the collar body, including a threaded rod threaded to lower threaded holes in the collar body, and a nut threaded to the threaded rod.

4. A nozzle adaptor including a protective collar for preventing loosening of the adaptor from a fill pipe having an axis, the nozzle adaptor being threaded to the fill pipe, the adaptor comprising:

(a) an adaptor body having threads for being threaded to the fill pipe;

(b) a lower skirt unitary with the adaptor body; and (c) a bracing assembly mounted to the lower skirt for bracing the adaptor body against and engaging walls of a spill bucket in which the adaptor and fill pipe are located, whereby rotation of the adaptor body with respect to the axis of the fill pipe is positively prevented.

5. The collar of claim 4 wherein each bracing assembly comprises a T-shaped member having a tubular stem and a cross member having one side attached to the tubular stem and another side, opposite the one side, having a friction pad attached thereto.

6. The collar of claim 5 further comprising means for telescopically mounting each bracing assembly to the lower skirt, including a threaded rod threaded to holes in the skirt, and a nut threaded to the threaded rod.

7. A fill pipe, nozzle adaptor and protective collar assembly, comprising:

(a) a fill pipe having a threaded end and an axis;

(b) a spill bucket defining walls in which the fill pipe is located;

(c) a nozzle adaptor having threads and being threaded to the threaded end of the fill pipe;

(d) a protective collar formed unitarily with the nozzle adaptor, the collar including threaded holes; and (e) means for bracing the collar against and engaging the walls of the spill bucket, whereby rotation of the nozzle adaptor with respect to the axis of the fill pipe is positively prevented.

8. The assembly of claim 7 wherein each means for bracing comprises a T-shaped member having a tubular stem and a cross member having one side attached to the tubular stem and another side, opposite the one side, having a friction pad for contacting the walls.

9. The collar of claim 8 further comprising means for telescopically mounting each bracing assembly to the collar, including a threaded rod threaded go holes in the collar, and a nut threaded to the rod.

* * * * *

UNITED STATES PATENT AND TRADEMARK OFFICE

CERTIFICATE OF CORRECTION

PATENT NO. : 5,564,858
DATED : October 15, 1996
INVENTOR(S) : Sergio M. Bravo

It is certified that error appears in the above-indentified patent and that said Letters Patent is hereby corrected as shown below:

On the title page, Abstract, line 6, replace "standpipe" with -- fill pipe --.
Column 1, line 8, change "filing" to -- filling --.
Column 1, line 23, change "lose" to -- loose --.
Column 1, line 33, change "pipe," to -- pipe. --.
Column 1, line 61, replace "standpipe" with -- fill pipe --.
Column 3, line 61, replace "interrupted" with -- interpreted --.
Column 4, line 11, change "T-Shaped" to -- T-shaped --.
Column 4, line 64, replace "go" with -- to --.

Signed and Sealed this

Sixteenth Day of September, 1997

*Attest:*

Bruce Lehman

BRUCE LEHMAN

*Attesting Officer*

*Commissioner of Patents and Trademarks*